US008107652B2

(12) United States Patent
Dyer et al.

(10) Patent No.: US 8,107,652 B2
(45) Date of Patent: Jan. 31, 2012

(54) CONTROLLED LEAKAGE OMNIDIRECTIONAL ELECTRET CONDENSER MICROPHONE ELEMENT

(75) Inventors: Medford Alan Dyer, San Diego, CA (US); Christopher Todd Welsh, Fishers, IN (US); Jeffrey Phillip McAteer, Carmel, IN (US); Alan Dean Michel, Fishers, IN (US); John Charles Baumhauer, Jr., Indianapolis, IN (US)

(73) Assignee: MWM Mobile Products, LLC, Indianapolis, IN (US)

( * ) Notice: Subject to any disclaimer, the term of this patent is extended or adjusted under 35 U.S.C. 154(b) by 805 days.

(21) Appl. No.: 12/221,644

(22) Filed: Aug. 4, 2008

(65) Prior Publication Data

US 2010/0027817 A1 Feb. 4, 2010

(51) Int. Cl.
*H04R 11/04* (2006.01)

(52) U.S. Cl. ..... 381/191; 381/174; 381/355; 381/369

(58) Field of Classification Search ..... 381/174, 381/191, 355, 356, 357, 358, 369
See application file for complete search history.

(56) References Cited

U.S. PATENT DOCUMENTS

2009/0257613 A1* 10/2009 Khamashta et al. ..... 381/355
* cited by examiner

*Primary Examiner* — Lex Malsawma
(74) *Attorney, Agent, or Firm* — Patent Law Office of David G. Beck

(57) ABSTRACT

An omnidirectional electret condenser microphone element with improved low frequency background ambient acoustical noise rejection is provided. The omnidirectional electret condenser microphone element includes a plurality of passageways in acoustic series that couple at least one acoustic aperture of the microphone element to an acoustic cavity formed within the microphone element. At least one of said plurality of passageways is of a predefined size that is determined to provide the desired response roll-off within a predefined frequency range. In at least one preferred configuration, the roll-off resulting from the plurality of passageways is greater than 2.0 dB between 300 and 100 Hz. In at least one alternate preferred configuration, the roll-off resulting from the plurality of passageways is greater than 3.0 dB between 300 and 100 Hz.

14 Claims, 5 Drawing Sheets

CONTROLLED LEAKAGE OMNIDIRECTIONAL ELECTRET CONDENSER MICROPHONE ELEMENT

FIELD OF THE INVENTION

The present invention relates generally to microphones and, more particularly, to an omnidirectional electret condenser microphone element designed for use in an acoustically noisy environment.

BACKGROUND OF THE INVENTION

Electret condenser microphone elements are well known in the art and used in a variety of applications, for example landline and cellular telephones, broadcast and recording systems, communication headsets, and computer microphones. Such microphone elements can be designed to be either directional or omnidirectional, depending upon the desired application and performance requirements.

The designs for directional and omnidirectional microphone elements can differ in a variety of ways. One of the principal distinguishing design features between these two microphone designs is in the placement of the sound port(s), also referred to herein as an acoustic aperture(s). In a directional microphone, there are at least two spatially separated sound ports, this feature leading to a decreased pick-up of low frequency background ambient acoustical noise. In contrast, in an omnidirectional microphone element the sound port is located in a single spatial position, even if the microphone includes multiple ports. As a result of this design, omnidirectional microphone elements are less susceptible to the pick-up of wind noise than directional microphone elements. Wind or turbulent-type noise is present any time air is flowing past the microphone aperture(s), such as in automotive environments or from a fan.

Although in general omnidirectional microphone elements are less susceptible to wind noise than directional microphone elements, their lack of spatial discrimination can allow decreased signal quality when used in environments in which the primary audio signal source, e.g., the intended speaker, is surrounded by a high level of background ambient noise (e.g., traffic noise, machinery including engine and HVAC noise, and background vocal noise). Additionally, as omnidirectional microphone elements have a generally flat frequency response from about 50 or 100 Hz to about 10 kHz, they are further prone to picking up background ambient noise since the sound pressure levels associated with typical background ambient noise increase at lower frequencies. In contrast, background ambient noise is less problematic for directional microphone elements which exhibit a natural response roll-off at lower frequencies, and importantly because they spatially discriminate against acoustical noise from selected directions.

FIG. 1 is a cross-sectional view of an exemplary configuration of a conventional omnidirectional electret microphone element 100. Microphone 100 is comprised of an electrically conductive, cylindrical casing 101. The front face 103 of one end portion of casing 101 includes one or more, substantially co-located, acoustic apertures 105. An electrode plate 107 with one or more secondary acoustic apertures 109 fits against the inner surface of front portion 103 of casing 101. An electret material 111 is deposited on, or otherwise applied to, the inner surface of electrode 107. A metallized diaphragm 113 is separated from electret material layer 111 by an electrically insulating spacer 115.

A circuit board 117 fits within, and covers, the casing opening located at the distal end opposite front face 103. One or more signal processing elements 119 (e.g., a field effect transistor or FET) are attached to circuit board 117 and contained within casing 101 as shown. Electrode patterns on circuit board 117, represented by raised contact regions 118, are used in conjunction with electrically conductive casing 101 to couple signal processing element 119 to electrode plate 107. Metallized diaphragm 113 is coupled to signal processing element 119 via an electrically conductive spacer 121 and a raised contact region 123 located on the bottom surface of circuit board 117. Spacer 121 is typically ring-shaped. A second electrically insulating spacer 125, typically ring-shaped, is used to prevent shorting of spacer 121 to casing 101 as well as insuring that spacer 121 is properly positioned relative to contact region 123. End edge portion 127 of casing 101 is folded over and crimped, thereby compressing circuit board 117, spacer 121, and metallized diaphragm 113 against each other and holding the individual components in place. Solder bumps 129 are used to electrically couple the microphone element to the intended device (i.e., cell phone, camcorder, etc.).

As known by those of skill in the art, there are numerous possible configurations for a conventional omnidirectional electret condenser microphone element. The microphone element described above relative to FIG. 1 is but one such configuration, generally referred to as an inverted back-electret arrangement. Another exemplary prior art arrangement, referred to as a back-electret arrangement, reverses the positions of elements 107, 111, 115, and 113, placing electrode 107 toward the back of the structure. In such a configuration, electrode 107 is usually called the backplate. In yet another exemplary prior art arrangement, referred to as a foil-electret arrangement, the electret material layer is deposited on the diaphragm instead of being placed on the electrode. In both alternate configurations briefly described above, other changes to the structure are necessary.

In at least one conventional omnidirectional electret condenser microphone element known to the inventors, means are provided to achieve quasi-static pressure equalization between internal microphone volume 131 and the ambient environment. It will be appreciated that pressure equalization means can be specifically designed into the element, for example utilizing a leakage passageway as described more fully below, or by taking advantage of the normal mismatch between components within the microphone assembly. Quasi-static pressure equalization is often desired to avoid potentially damaging the diaphragm when the microphone is subjected to sudden and major pressure changes, for example those commonly encountered during air shipment. At the same time, and as known by those of skill in the art, the means used to provide pressure equalization must allow only minor air leakage between the ambient environment and volume 131, otherwise the microphone element will fail to operate properly and to provide the desired electro-acoustic response. In a typical omnidirectional electret condenser microphone element utilizing pressure equalization means, the leakage passageway is small enough that only frequencies below the audio band, for example near 5-10 Hz, are affected.

FIG. 2 illustrates a conventional omnidirectional electret condenser microphone element similar to the microphone element shown in FIG. 1, with the addition of a pair of pressure equalization leakage passageways that have been designed into the assembly. Such pressure equalization leakage passageways are known in the art. As previously noted, normal component mismatch within the assembly is often used to accomplish a similarly sized air leak.

As shown in FIG. 2, microphone element 200 includes a pair of small passageways 201 and 203 that allow air to leak around circuit board 117, thereby coupling the ambient environment to acoustic volume 131. Passageway 201 is formed by including a slot between crimped casing end portion 127 and the upper surface of circuit board 117. This slot, referred to in FIG. 2 by passageway 201, is formed by including an interruption within contact region 118 so that when edge portion 127 is crimped against the circuit board an air passageway remains. Similarly, passageway 203 is formed by including an interruption within contact region 123 that remains after circuit board 117 is pressed against spacer 121. Accordingly passageways 201 and 203, in combination with the use of a circuit board 117 that has a slightly smaller outside diameter than the inside diameter of casing 101, allows air to leak around the circuit board, thereby achieving the desired pressure equalization.

FIGS. 3 and 4 illustrate another observed modification of the electret condenser microphone element of FIG. 1. Microphone 300, which exhibits the typical, substantially flat response of an omnidirectional microphone, includes a notch 301 in the front surface 401 of casing 303.

What is needed in the art is an omnidirectional electret condenser microphone element, such as the conventional unit described above, but in which the design has been modified to reduce the pick-up of background noise, thereby providing an enhanced signal-to-acoustic background ambient noise ratio. The present invention provides a means for achieving such a microphone.

SUMMARY OF THE INVENTION

The present invention provides an omnidirectional electret condenser microphone element with improved low frequency background ambient acoustical noise rejection. The omnidirectional electret condenser microphone element of the invention includes a plurality of passageways in acoustic series that couple at least one acoustic aperture of the microphone element to an acoustic cavity formed within the microphone element. At least one of said plurality of passageways is of a predefined size that is determined to provide the desired frequency response roll-off within a predefined frequency range. In at least one embodiment, the roll-off resulting from the plurality of passageways is greater than 2.0 dB between 300 and 100 Hz. In at least one other embodiment, the roll-off resulting from the plurality of passageways is greater than 3.0 dB between 300 and 100 Hz.

In one aspect of the invention, an omnidirectional electret condenser microphone element is provided with an acoustic roll-off of at least 2.0 dB between 300 Hz and 100 Hz, the microphone element comprised of an electrically conductive casing with a first end portion that includes at least one acoustic aperture, a circuit board disposed within the casing and closing an opening at a second end portion of the casing, a diaphragm disposed within the casing, and a plurality of passageways that produce the microphone's acoustic roll-off and that couple the at least one acoustic aperture to an acoustic cavity formed within the casing and interposed between the diaphragm and the circuit board.

In another aspect of the invention, an omnidirectional electret condenser microphone element is provided that is comprised of an electrically conductive casing with a first end portion that includes at least one acoustic aperture, a circuit board disposed within the conductive casing and closing an opening at a second end portion of the electrically conductive casing, an electrode plate disposed within the electrically conductive casing, an electret material applied to a surface of the electrode plate, a metallized diaphragm disposed within the electrically conductive casing, an electrically insulating spacer interposed between the electret material and the metallized diaphragm, an electrically conductive spacer interposed between the metallized diaphragm and the circuit board, a signal processing unit disposed on the circuit board and electrically connected to the electret material and the metallized diaphragm, an acoustic cavity formed within the electrically conductive casing and defined by the metallized diaphragm and the circuit board, a first passageway coupling the at least one acoustic aperture to an air volume defined by an inner surface of the electrically conductive casing and an outer surface of the electrically conductive spacer, and a second passageway in acoustic series with the first passageway and coupling the air volume to the acoustic cavity. Preferably the first and second passageways produce an acoustic roll-off of at least 2.0 dB between 300 Hz and 100 Hz; alternately the first and second passageways produce an acoustic roll-off of at least 3.0 dB between 300 Hz and 100 Hz.

In another aspect of the invention, a method of providing acoustically-driven roll-off between a first frequency and a second frequency within an omnidirectional electret condenser microphone element is provided, the method comprising the steps of (i) providing a plurality of passageways in acoustic series within the microphone element, the plurality of passageways coupling at least one acoustic aperture of the microphone element to an acoustic cavity formed within the microphone element, and (ii) sizing the plurality of passageways according to the formula $R_A=20 \log 10 [r_{First\ Frequency}/r_{Second\ Frequency}]$, where $R_A$ is equal to the acoustically-driven frequency response roll-off, where $r_{Frequency}$ is equal to $[C_2 (a^2+b^2)^{0.5}]/[\{(ad)^2+(1-bd)^2\}^{0.5}]$, where d is equal to $1+C_2/C_1$, where a is equal to $\omega C_1 R$, where b is equal to $\omega^2 C_1 L$, where $\omega$ is equal to $2\pi f$, where f is the frequency, where $C_1$ is the effective acoustical compliance of a diaphragm mounted within the omnidirectional electret condenser microphone element and is equal to $A^2/(8\pi S)$, where $C_2$ is the acoustical compliance of the acoustic cavity and is equal to $V/(\rho c^2)$, where A is equal to the area of the diaphragm, where S is equal to the radial tension of the diaphragm, where V is equal to the volume of the acoustic cavity, where $\rho$ is equal to the density of air, where c is equal to the sound wave velocity in air, where R is the real part of the acoustic impedance of the plurality of passageways and is equal to $12 \rho\mu D/(N W H^3)$, where L is the imaginary part of the acoustic impedance of the plurality of passageways and is equal to $6 \rho D/(5N W H)$, where $\mu$ is equal to the effective kinematic coefficient of the viscosity of air, where N is equal to the number of parallel legs forming a given leakage passageway, where D is equal to the passageway length, where W is equal to the passageway width, and where H is equal to the passageway height.

A further understanding of the nature and advantages of the present invention may be realized by reference to the remaining portions of the specification and the drawings.

DESCRIPTION OF THE SPECIFIC EMBODIMENTS

The inventors have found that it is possible to achieve many of the benefits associated with a conventional omnidirectional electret condenser microphone element while improving upon its background ambient noise rejection, more specifically improving the signal-to-noise ratio at low frequencies. The inventors have found it advantageous to roll-off the low frequency response, preferably by at least 2.0 dB, and more preferably by at least 3.0 dB, between an upper frequency of 100 Hz and a lower frequency of 300 Hz. This audio band was selected since the low frequency portion of the voice signal, while easily corrupted by acoustical noise, carries very little of the audio intelligibility of speech. For example, high-pass filtering a typical speech signal above 300 Hz will reduce the intelligibility by only about 3%. It should be appreciated, however, that the method described in detail below can be used to adjust the low frequency roll-off within other audio bands.

In order to accomplish the benefits of the invention, the microphone element is configured to include two or more leakage passageways of a predetermined size that couple the input acoustic aperture to the acoustic cavity located within the microphone and behind the diaphragm. By properly sizing these passageways, or at least properly sizing the controlling passageway, low frequency sounds in which acoustic background noise is concentrated are presented to both sides of the diaphragm, thereby partially canceling these sounds and thus decreasing their influence upon the diaphragm and hence microphone output. As described more fully below, the degree of acoustic cancellation is controlled by the frequency, the design of the leakage passageways, the tensioned diaphragm's effective acoustical compliance, and the acoustic cavity air volume.

Figure 1:
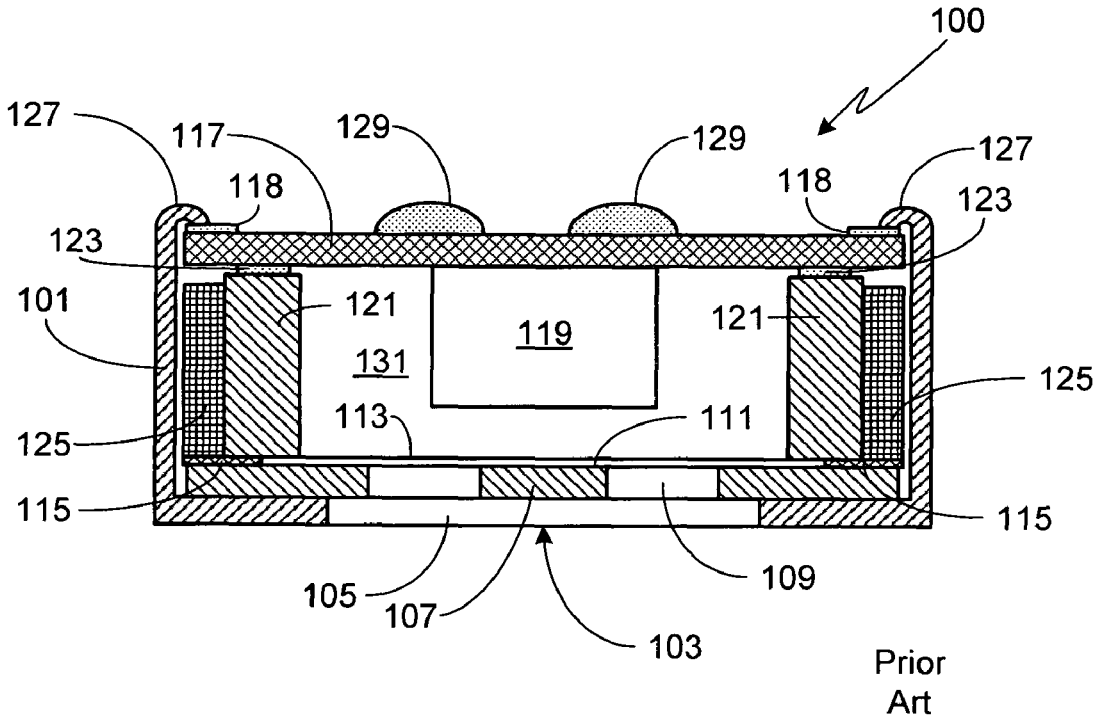
FIG. 1 is a cross-sectional view of a conventional omnidirectional electret condenser microphone element in accordance with the prior art.
Figure 2:
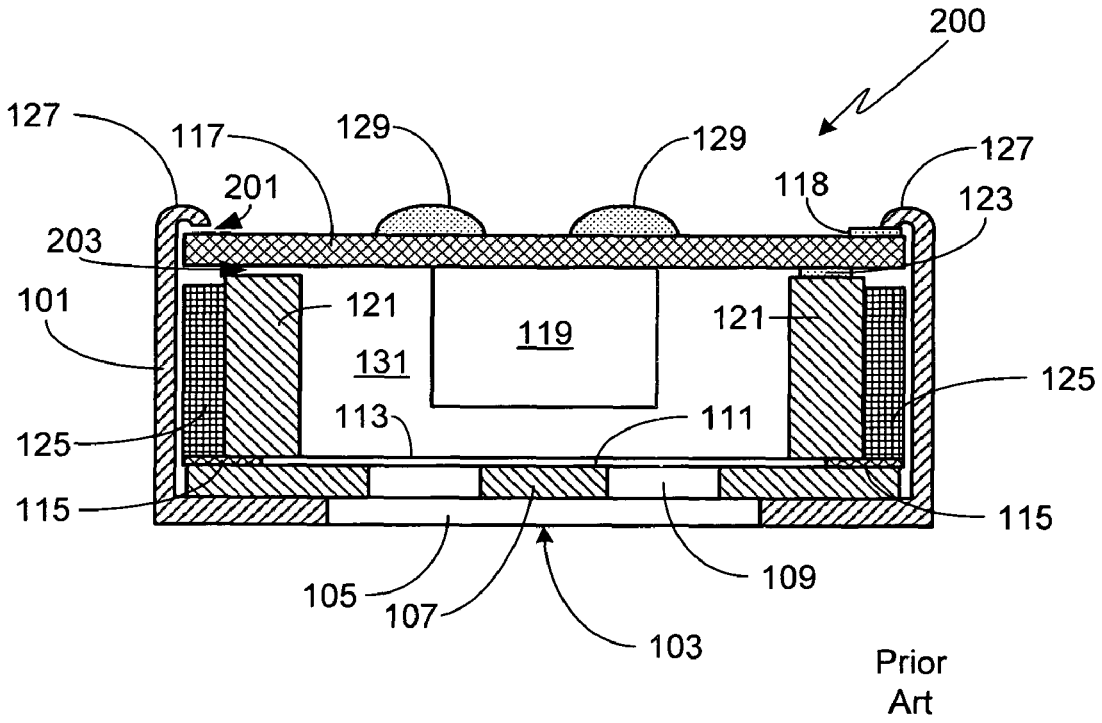
FIG. 2 is a cross-sectional view of a conventional omnidirectional electret condenser microphone element, similar to that shown in FIG. 1, with the addition of leakage passageways.
Figure 3:
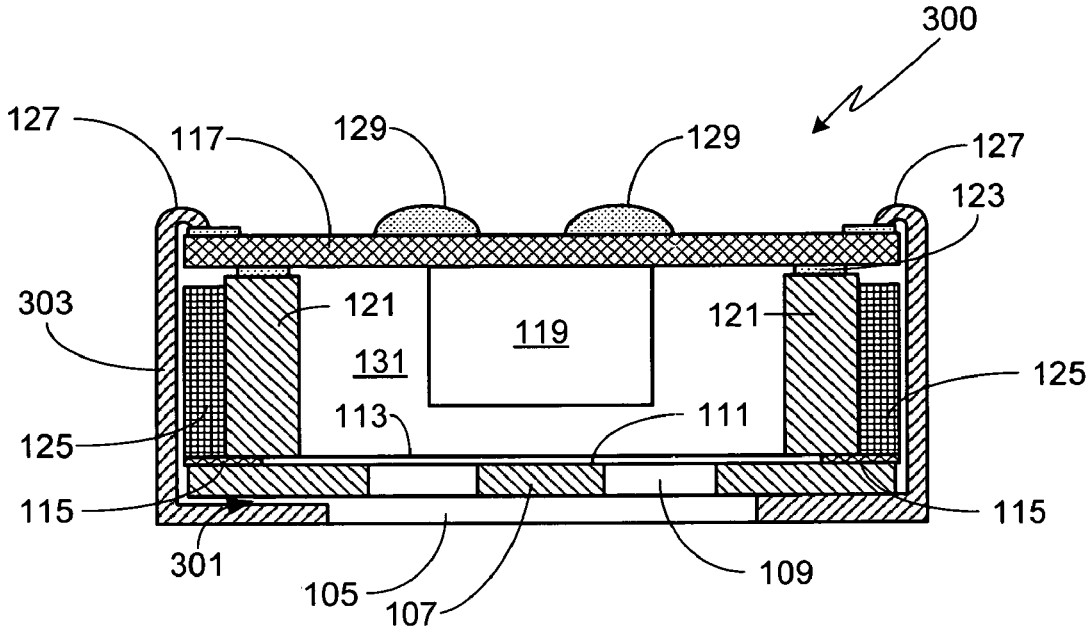
FIG. 3 Prior Art
FIG. 3 is a cross-sectional view of a conventional omnidirectional electret condenser microphone element, similar to that shown in FIG. 1, with the addition of a notched microphone casing.
Figure 4:
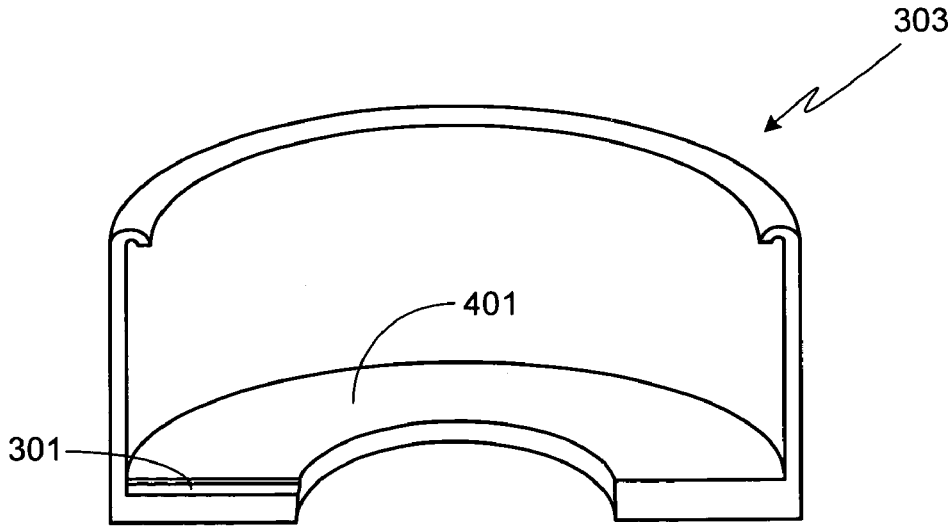
FIG. 4 Prior Art
FIG. 4 is a perspective cross-sectional view of the casing of the microphone shown in FIG. 3.
Figure 5:
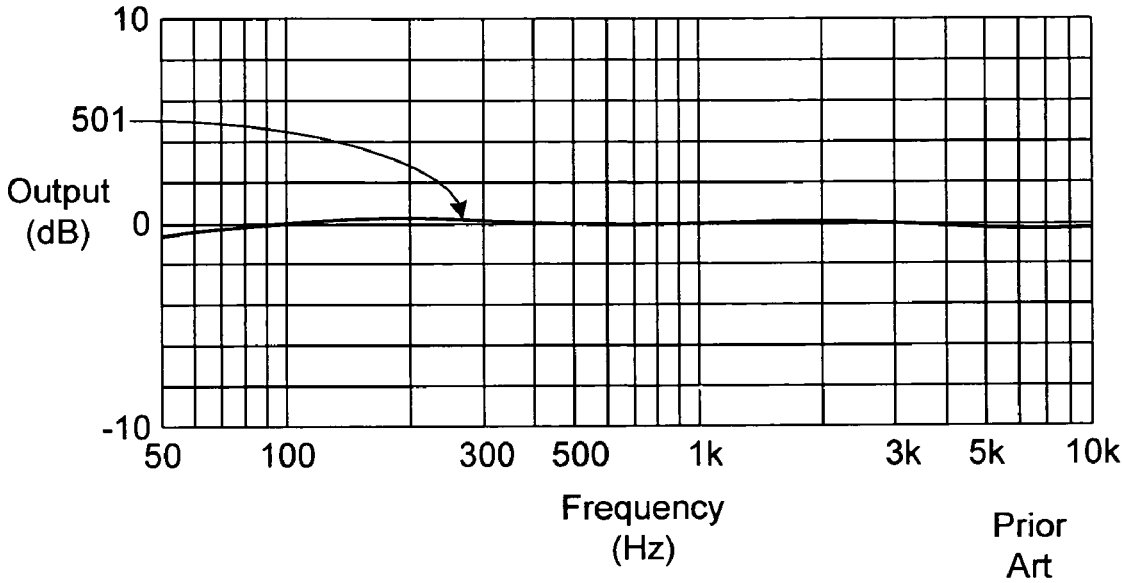
FIG. 5 is the frequency response curve of an exemplary conventional omnidirectional electret condenser microphone element.

FIG. 5 is an illustration of an exemplary frequency response curve 501 for a conventional omnidirectional electret condenser microphone element. As shown, the response of this microphone is relatively flat throughout the entire audio band, showing just a slight roll-off of approximately 1 dB at 50 Hz.

Figure 6:
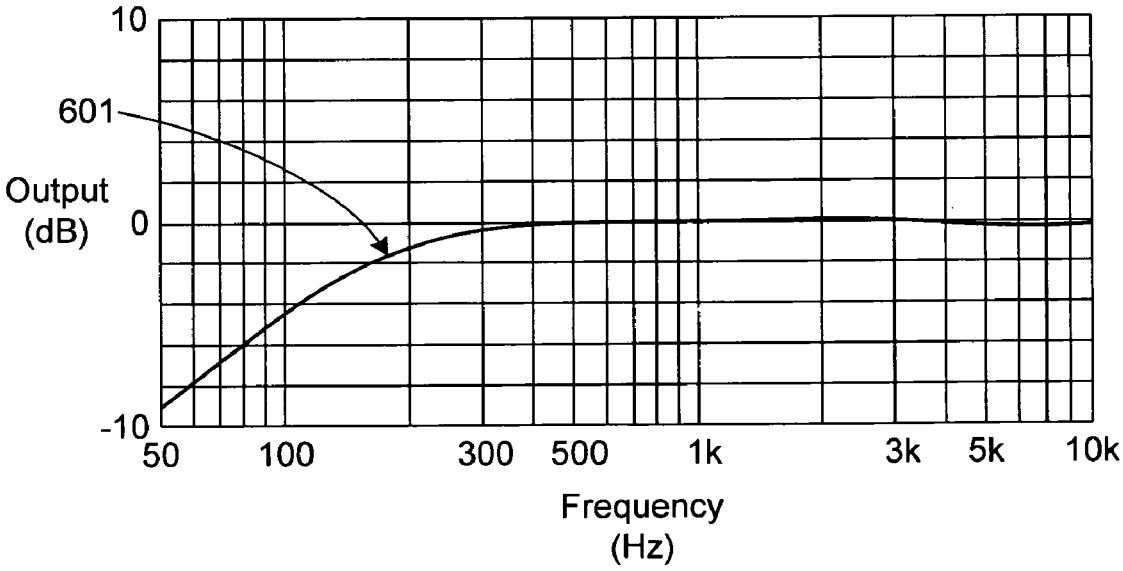
FIG. 6 is the frequency response curve of an exemplary omnidirectional electret condenser microphone element that has been modified in accordance with the invention.
Figure 7:
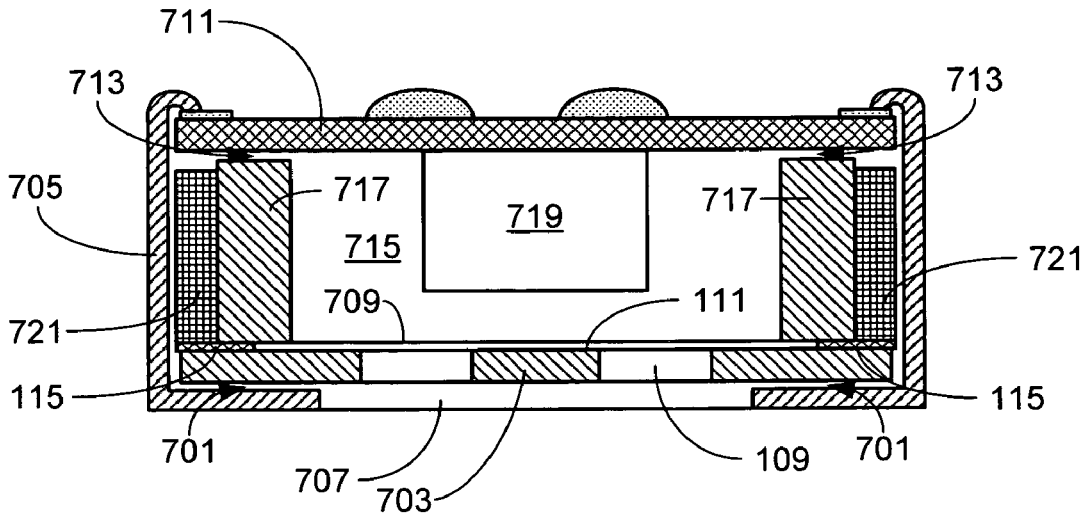
FIG. 7 is a cross-sectional view of a conventional omnidirectional electret condenser microphone element, similar to that shown in FIG. 1, that has been modified in accordance with the invention.
Figure 8:
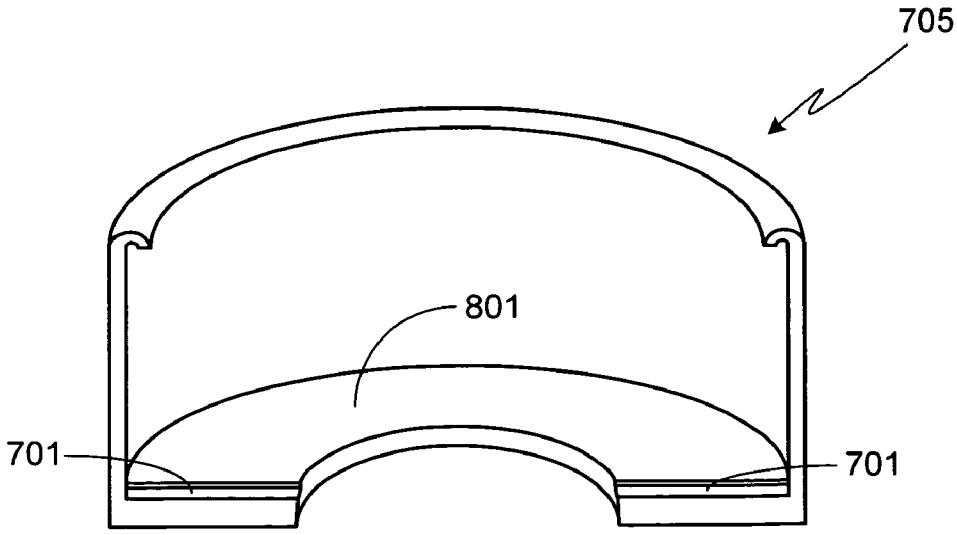
FIG. 8 is a perspective cross-sectional view of the casing of the microphone shown in FIG. 7.

FIG. 6 an illustration of an exemplary frequency response curve 601 for a omnidirectional electret condenser microphone element that has been modified in accordance with the invention. The modified omnidirectional electret condenser microphone element, as shown in FIG. 7, includes two slotted regions 701 that acoustically equate to a single leakage passageway. As shown more clearly in FIG. 8, slotted regions 701 are formed in the casing's inner front surface 801, thus allowing them to remain open when electrode plate 703 is pressed against the inner front surface of casing 705. As a result of this design, the same sound waves that impinge on acoustic aperture 707 pass through slotted regions 701, at least to the extent allowed by the size of the acoustic passageway as described further below. Regions 701 can be fabricated within casing 705 using any of a variety of techniques, for example milling, stamping, etc. It will be appreciated that this approach is only one of many that can be used to provide a leakage passageway through the casing. For example, instead of fabricating the airways into the inner front surface of casing 705, the airways can be fabricated into the complementary surface of electrode 703.

Figure 9:
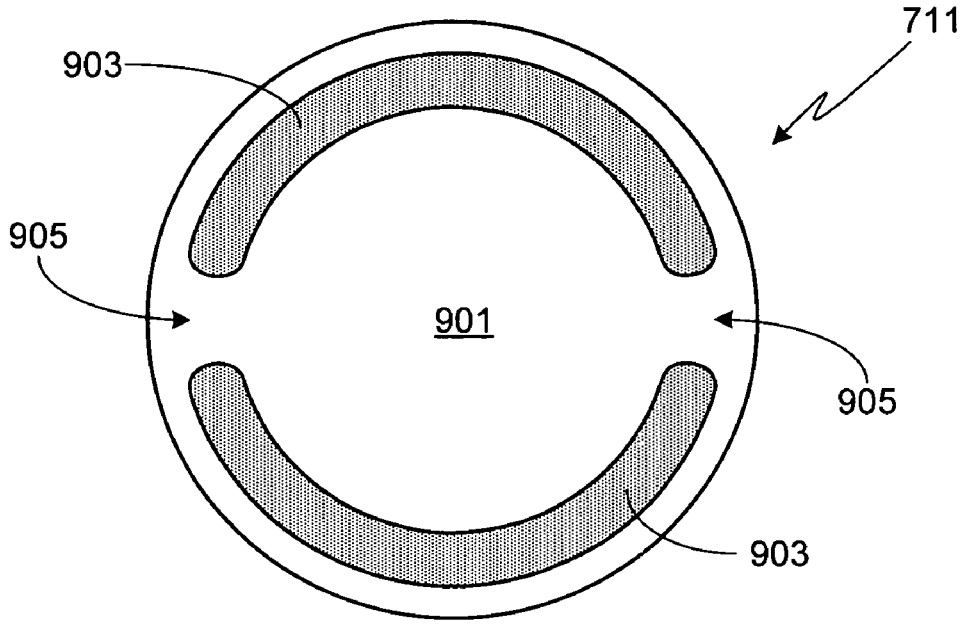
FIG. 9 is a bottom view of the circuit board of the microphone element shown in FIG. 7.

A variety of techniques can be used to couple metallized diaphragm 709 to circuit board 711 while still providing one or more airways 713 that allow the air passing through passageways 701 to couple to acoustic volume 715. For example, the electrically conductive spacer 717 that couples diaphragm 709 to circuit board 711 can include one or more airways (not shown). In the preferred embodiment, however, the air passageways around spacer 717 are fabricated on the circuit board 711, specifically by including interruptions within the raised contact region on the bottom surface of circuit board 711. As shown in the bottom view of circuit board 711 provided by FIG. 9, bottom surface 901 includes a raised contact region 903. Contact region 903 includes at least one, and preferably two, interruptions 905 within the raised contact region, these contact interruptions constituting air passageways 713. During assembly, contact region 903 of circuit board 711 is pressed against spacer 717, thus electrically connecting metallized diaphragm 709 to the circuit board and associated signal converting unit 719. Due to airways 713, after assembly a passageway remains between spacer 717 and circuit board 711, thus allowing air and sound that initially enters the assembly through passageways 701 to pass around the internal microphone elements and impinge on the back surface of diaphragm 709.

Figure 10:
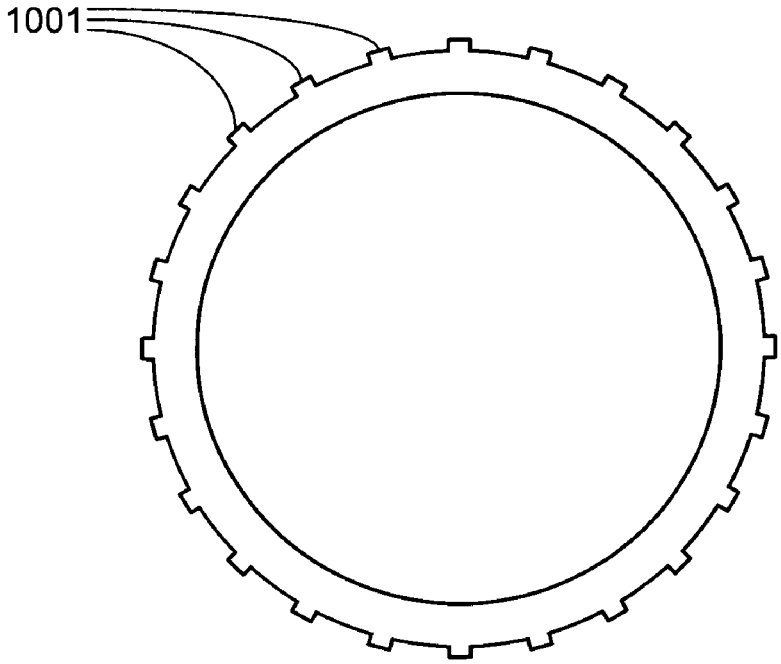
FIG. 10 is a top view of one configuration of the insulating spacer used in the microphone element shown in FIG. 7.

With respect to electrically insulating spacer 721, as previously described this spacer is typically used to insure spacer 717 does not accidentally short out against casing 705. Spacer 721 also helps to insure the proper placement of spacer 717 relative to contact region 903. In one embodiment, spacer 721 is simply smaller than required, thus insuring that there are multiple air leakage pathways around the spacer. Alternately and as illustrated in the top view of FIG. 10, spacer 721 has multiple teeth 1001 in a manner similar to that of a gear, thus insuring that spacers 717 and 721 are properly located within the microphone assembly while still providing air passageways.

Although not required by the preferred embodiment described relative to FIG. 7, preferably casing 705 is sealed against circuit board 711, for example using crimped region 127.

The roll-off, RO, in an omnidirectional electret condenser microphone element is equivalent to the sum of the roll-off, $R_E$, that is due to the electrical signal processing of the element and the roll-off, $R_A$, that is due to the inclusion of a controlled leakage pathway. As $R_E$ is negligible in a conventional omnidirectional microphone, in this case RO is equivalent to $R_A$. $R_A$, and thus RO, is given by the following equation:

$$R_A=20\log 10[r_{300\,Hz}/r_{100\,Hz}](\text{dB}),\text{ where}$$

$$r=[C_2(a^2+b^2)^{0.5}]/[\{(ad)^2+(1-bd)^2\}^{0.5}],\text{ and}$$

$$d=1+C_2/C_1,\ a=\omega C_1R,\ b=\omega^2C_1L,\ \omega=2\pi f.$$

In these equations, f is the frequency in Hz, $C_1$ is the effective acoustical compliance of the diaphragm (e.g., diaphragm 709 in FIG. 7) as mounted while $C_2$ is the acoustical compliance of the rear acoustic cavity (e.g., cavity 715 in FIG. 7). These two quantities are given by:

$$C_1=A^2/(8\pi S)(m^5/N),\text{ where}$$

A=diaphragm area ($m^2$), and S=radial tension (N/m).
and $$C_2=V/(\rho C^2)(m^5/N),\text{ where}$$

V=rear acoustic cavity volume ($m^3$), ρ=density of air=1.21 kgm/$m^3$, and c=sound wave velocity in air=343 m/s.

R and L are the real and imaginary parts, respectively, of the acoustic impedance of the leakage passageway, which are given by:

$$R=12\rho\mu/(NWH^3)(Nsm^{-5})\text{ and}$$

$$L=6\rho D/(5NWH)(\text{kgms m}^{-4}),\text{ where}$$

μ=effective kinematic coefficient of the viscosity of air=$2.2\times10^{-5}$ $m^2$/s, N=number of slotted regions constituting the acoustic passageway D=passageway length in m, W=passageway width in m, and H=passageway height in m and is the smallest dimension.

It will be noted that r in the above equations is the magnitude of the complex volume-displacement per unit pressure in units of $m^6$/N impressed upon the acoustic aperture. Additionally, it should also be noted that the leakage system acoustical impedance shunts, i.e., is in parallel with, the diaphragm impedance.

In the preferred embodiment of the invention, illustrated in FIG. 7, the inventors have made passageways 713 much larger than passageways 701. As a result, the acoustical impedance associated with passageways 713 is small compared to the acoustical impedance associated with passageways 701. Since these passageways are acoustically in series, the acoustical impedance of passageway 713 can be ignored in this situation.

In an exemplary embodiment, H is equal to $0.023\times10^{-3}$ m, W is equal to $0.30\times10^{-3}$ m, D is equal to $0.82\times10^{-3}$ m, N is equal to 2, V is equal to $1.9\times10^{-9}$ $m^3$, S is equal to 30 N $m^{-1}$, and A is equal to $5.0\times10^{-6}$ $m^2$. For this configuration, a roll-off of 2.5 dB is calculated between 300 and 100 Hz.

In a preferred embodiment, H is equal to 0.027×m, W is equal to $0.30\times10^{-3}$ m, D is equal to $0.82\times10^{-3}$ m, N is equal to 2, V is equal to $1.9\times10^{-9}$ $m^3$, S is equal to 30 N $m^{-1}$, and A is equal to $5.0\times10^{-6}$ $m^2$. For this configuration, a roll-off of 4.0 dB is calculated between 300 and 100 Hz.

It will be appreciated that if the acoustical impedance of the other passageway (e.g., passageways 713) is significant, the two R and two L for each passageway can be summed.

As will be understood by those familiar with the art, the present invention may be embodied in any of a variety of microphone configurations without departing from the spirit or essential characteristics thereof. Accordingly, the disclosures and descriptions herein are intended to be illustrative, but not limiting, of the scope of the invention which is set forth in the following claims.

What is claimed is:

1. An omnidirectional electret condenser microphone element comprising:

an electrically conductive casing, wherein said electrically conductive casing has a first end portion and a second end portion, wherein said first end portion is comprised of at least one acoustic aperture;

a circuit board disposed within said casing and closing an opening at said second end portion of said electrically conductive casing;

a diaphragm disposed within said electrically conductive casing, wherein a first surface of said diaphragm is outwardly directed towards said at least one acoustic aperture and wherein a second surface of said diaphragm is inwardly directed towards said circuit board;

a spacer interposed between said diaphragm and said circuit board;

an acoustic cavity formed within said electrically conductive casing, wherein said acoustic cavity is at least partially defined by said second surface of said diaphragm, said circuit board, and said spacer; and at least a first air passageway and a second air passageway, wherein said first and second air passageways are in acoustic series, said at least first and second air passageways coupling said at least one acoustic aperture to said acoustic cavity formed within said electrically conductive casing, wherein at least one of said first and second air passageways provide an acoustic roll-off of at least 2.0 dB between 300 Hz and 100 Hz.

2. The omnidirectional electret condenser microphone element of claim 1, wherein said acoustic roll-off between 300 Hz and 100 Hz provided by said at least one of said first and second air passageways is of at least 3.0 dB.

3. An omnidirectional electret condenser microphone element comprising:

an electrically conductive casing, wherein said electrically conductive casing has a first end portion and a second end portion, wherein said first end portion is comprised of at least one acoustic aperture;

a circuit board disposed within said conductive casing and closing an opening at said second end portion of said electrically conductive casing, wherein a first circuit board contact region is electrically connected to said electrically conductive casing;

an electrode plate disposed within said electrically conductive casing, wherein said electrode plate is electrically connected to said electrically conductive casing, and wherein a first surface of said electrode plate is outwardly directed towards said at least one acoustic aperture and wherein a second surface of said electrode plate is inwardly directed towards said circuit board;

an electret material applied to said second surface of electrode plate;

a metallized diaphragm disposed within said electrically conductive casing, wherein a first surface of said metallized diaphragm is outwardly directed towards said at least one acoustic aperture and wherein a second surface of said metallized diaphragm is inwardly directed towards said circuit board;

an electrically insulating spacer interposed between said electret material and said metallized diaphragm;

an electrically conductive spacer interposed between said metallized diaphragm and said circuit board, wherein said metallized diaphragm is electrically connected to a second circuit board contact region via said electrically conductive spacer;

a signal processing unit disposed on said circuit board and electrically connected to said first and second circuit board contact regions;

an acoustic cavity formed within said electrically conductive casing, wherein said acoustic cavity is defined by said second surface of said metallized diaphragm, said circuit board and said electrically conductive spacer;

a first passageway coupling said at least one acoustic aperture to an air volume interposed between an inner surface of said electrically conductive casing and an outer surface of said electrically conductive spacer; and a second passageway coupling said air volume to said acoustic cavity, wherein said first and second passageways are in acoustic series, and wherein said first and second passageways couple said at least one acoustic aperture to said acoustic cavity.

4. The omnidirectional electret condenser microphone element of claim 3, further comprising a second electrically insulating spacer, wherein said second electrically insulating spacer is interposed between said outer surface of said electrically conductive spacer and said inner surface of said electrically conductive casing, and wherein said second electrically insulating spacer is contained within said air volume.

5. The omnidirectional electret condenser microphone element of claim 3, wherein said first and second passageways provide an acoustic roll-off of at least 2.0 dB.

6. The omnidirectional electret condenser microphone element of claim 5, wherein said acoustic roll-off is between 300 Hz and 100 Hz.

7. The omnidirectional electret condenser microphone element of claim 3, wherein said first and second passageways provide an acoustic roll-off of at least 3.0 dB.

8. The omnidirectional electret condenser microphone element of claim 7, wherein said acoustic roll-off is between 300 Hz and 100 Hz.

9. The omnidirectional electret condenser microphone element of claim 3, wherein said first passageway is comprised of at least one slotted region formed within a first end portion inner surface of said electrically conductive casing, wherein said at least one slotted region remains open after assembly of said omnidirectional electret condenser microphone element.

10. The omnidirectional electret condenser microphone element of claim 3, wherein said second passageway is comprised of at least one interruption within said second circuit board contact region, wherein said at least one interruption remains open after assembly of said omnidirectional electret condenser microphone element.

11. The omnidirectional electret condenser microphone element of claim 3, wherein a second passageway acoustical impedance is small compared to a first passageway acoustical impedance.

12. A method of providing acoustically-driven roll-off between a first frequency and a second frequency within an omnidirectional electret condenser microphone element, wherein said first frequency is larger than said second frequency, the method comprising the steps of:

providing a plurality of passageways in acoustic series within said omnidirectional electret condenser microphone element, said plurality of passageways coupling at least one acoustic aperture of said omnidirectional electret condenser microphone element to an acoustic cavity formed within said omnidirectional electret condenser microphone element; and sizing said plurality of passageways according to the formula $R_A=20 \log 10 [r_{First\ Frequency}/r_{Second\ Frequency}]$, where $R_A$ is equal to the acoustically-driven frequency response roll-off, where $r_{Frequency}$ is equal to $[C_2 (a^2+b^2)^{0.5}]/[\{(ad)^2+(1-bd)^2\}^{0.5}]$, where d is equal to $1+C_2/C_1$, where a is equal to $\omega C_1 R$, where b is equal to $\omega^2 C_1 L$, where $\omega$ is equal to $2\pi f$, where f is the frequency, where $C_1$ is the effective acoustical compliance of a diaphragm mounted within said omnidirectional electret condenser microphone element and is equal to $A^2/(8\pi S)$, where $C_2$ is the acoustical compliance of the acoustic cavity and is equal to $V/(\rho c^2)$, where A is equal to the area of the diaphragm, where S is equal to the radial tension of the diaphragm, where V is equal to the volume of the acoustic cavity, where $\rho$ is equal to the density of air, where c is equal to the sound wave velocity in air, where R is the real part of the acoustic impedance of the plurality of passageways in acoustical series and is equal to $12 \rho\mu D/(N W H^3)$, where L is the imaginary part of the acoustic impedance of the plurality of passageways in acoustical series and is equal to $6 \rho D/(5N W H)$, where $\mu$ is equal to the effective kinematic coefficient of the viscosity of air, where N is equal to the number of regions forming a leakage passageway, where D is equal to the passageway length, where W is equal to the passageway width, and where H is equal to the passageway height.

13. The method of claim 12, wherein an acoustic impedance of one of said plurality of passageways controls said $R_A$, and wherein said quantities N, D, W, and H correspond to said one of said plurality of passageways.

14. The method of claim 12, wherein said plurality of passageways is comprised of at least one passageway of a first configuration and at least one passageway of a second configuration, wherein an acoustic impedance corresponding to said at least one passageway of said first configuration controls said $R_A$, and wherein said quantities N, D, W, and H correspond to said at least one passageway of said first configuration.

* * * * *